US005150791A

United States Patent [19]

Kamen et al.

[11] Patent Number: 5,150,791

[45] Date of Patent: Sep. 29, 1992

[54] COSMETIC COLOR DISPLAY APPARATUS AND METHODS

[75] Inventors: Melvin E. Kamen, Highlands; Philip Bernstein, Glen Ridge, both of N.J.

[73] Assignee: Revlon, Inc., New York, N.Y.

[21] Appl. No.: 652,691

[22] Filed: Feb. 8, 1991

Related U.S. Application Data

[63] Continuation of Ser. No. 329,659, Mar. 19, 1989, abandoned.

[51] Int. Cl.[5] ..... G09B 19/00; B65D 73/00

[52] U.S. Cl. ..... 206/457; 206/823; 206/459.5; 434/100; 401/194; 401/198

[58] Field of Search ..... 428/15, 16; 132/320, 132/317, 318; 264/245; 40/630, 638; 206/457, 459, 581, 823; 434/100; 401/194, 198

[56] References Cited

U.S. PATENT DOCUMENTS

| | | | |
|---|---|---|---|
| 2,032,807 | 3/1936 | Masbach | 206/457 X |
| 2,195,495 | 4/1940 | Popp | 434/100 |
| 2,223,842 | 12/1940 | Brekke | 434/100 |
| 2,248,011 | 7/1941 | Neuschaefer | 434/100 X |
| 2,299,277 | 10/1942 | Neuschaefer | 434/100 |
| 2,417,677 | 3/1947 | Cohan | 434/100 |
| 3,990,577 | 11/1976 | Delia | 206/457 |
| 4,373,632 | 2/1983 | Van Zanbt | 206/457 |
| 4,668,457 | 5/1987 | Nakai et al. | 428/15 X |

*Primary Examiner*—Paul T. Sewell
*Assistant Examiner*—Jacob K. Ackun, Jr.
*Attorney, Agent, or Firm*—Julie Blackburn

[57] ABSTRACT

A module of a thermoplastic impregnated with a cosmetic color is fabricated using ethylene vinyl acetate (EVA) as the thermoplastic. The module may have an adhesive layer secured to one surface for securing the module to various carrier substrates as cosmetic containers, carrier dispensing layers or the skin of a user for providing a true indication of cosmetic color. The cosmetic color may actually be a sample of the cosmetic being provided or a sample of the color formulation as prepared during the manufacture of the cosmetic.

9 Claims, 1 Drawing Sheet

COSMETIC COLOR DISPLAY APPARATUS AND METHODS

This is a continuation of copending application Ser. No. 07/329,659 filed on Mar. 19, 1989, now abandoned.

BACKGROUND OF THE INVENTION

This invention relates to cosmetic color displays in general and more particularly to a cosmetic color display employing a hot melt adhesive module having the exact cosmetic color formulation impregnated in said module in order to allow a user to ascertain the color of the cosmetic.

As is well known, a very important aspect of the entire cosmetic industry is the preparation and distribution of various cosmetic products which contain color. For example, various lipsticks, powders, eye make-ups and so on are available in a wide variety of colors.

As one can further ascertain, it is extremely difficult to accurately represent such colors in advertisements or elsewhere. Such colors as available in a complete line of lipstick or other line of cosmetics had to be portrayed by various means to show all the various colors available. These means involve photographic or other means which attempted to show the different available colors by charts in order to inform the consumer of the color of the product.

A further problem is that upon formulation of various colored cosmetics the colors required may constitute a multitude of blended pigments or different color formulations used to arrive at a specific color or shade. Thus, each batch of materials may differ or vary from one to the other based on the color. These variations can occur due to the differences of pigment colors, pigment sizes as well as the blending or formulation process. These factors make it difficult to provide a consumer with accurate color information concerning the cosmetic product.

As one can ascertain, the term cosmetic includes articles intended to be rubbed, poured, sprinkled or sprayed on or otherwise applied to the human body or any part thereof for cleansing, beautifying, promoting attractiveness, or altering the appearance and articles intended for use as a component of any such articles except that the term does not include soap.

Face powders, lipstick, and nail polishes are examples of cosmetics which contain coloring material of various kinds. As one can ascertain, the color of cosmetics, especially in regard to lipsticks and nail polishes, is extremely important and there are a wide variety of color and shades employed. Due to the wide variety of colors, the display of such colors has been extremely difficult. Either one relies on photographs to determine the nature of the color or one relies on various color composition charts to show the consumer the color within a particular environment.

Coloring materials for example which are employed with face powder are either natural ground earth colors or certified organic colors. Color is considered the primary factor in face powders as is well known. Thus, the art of providing colors and the utilization of various pigments and various substances is an extremely important art and many companies have proprietary color formulations which have been extensively developed. It is a difficult and expensive to accurately display the color of the product on various containers and so on by using conventional techniques. In this regard each and every container would have to have either a photograph or some kind of color coordinated area which shows the color of the cosmetic product included within the container. This color can of course vary from batch to batch and may vary widely depending upon the blending process and so on. Hence, a prior art display of color is not accurate due to the many factors which can affect the color presented on the display as compared to the color presented on the product.

It is therefore an object, as indicated above, of the present invention to provide an accurate cosmetic color display.

It is a further object to provide a color display in the form of a module which is impregnated with the colored product or the exact color formulation used in manufacturing the product.

SUMMARY OF THE INVENTION

A color display module, comprising a thin planar member of a thermoplastic material having impregnated therein a cosmetic color formulation indicative of the true color of the cosmetic product associated with said formulation.

DETAILED DESCRIPTION OF THE FIGURES

Figure 1:
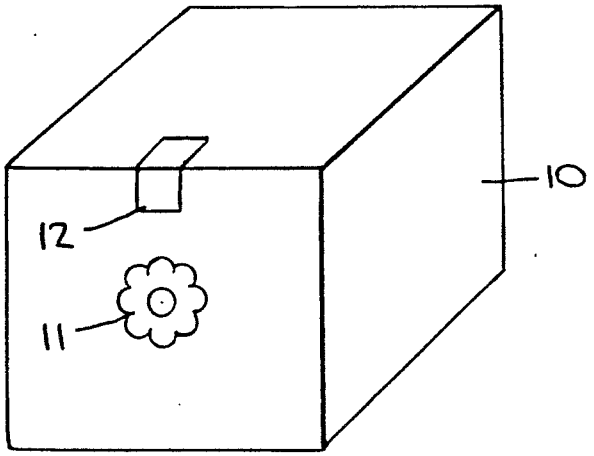
FIG. 1 is a plan view of a cosmetic carton having a color display according to this invention.

Referring to FIG. 1, there is shown a typical cardboard container 10. Container 10 may be fabricated from cardboard, plastic or any suitable material.

The container 10 conventionally houses a cosmetic product which has a color associated therewith such as a face power, lipstick, rouge and so on. As will be explained, the container 10 is associated with a closure 12 which serves to seal the container. The module 12 is designed according to the aspects of the present invention and contains the exact color composition which was utilized to fabricate the cosmetic as will be further explained.

The module 11 depicts another example of the type of color display which can be associated with the container as 10. Essentially, as will be explained, the module 12 preferably consists of an ethylene vinyl acetate (EVA) which material has been widely employed in the prior art. See a copending patent application entitled FRAGRANCE EMITTING HOT MELT ADHESIVE MODULES AND METHODS, filed on May 17, 1991, Ser. No. 07/704473. The EVA may be extended by the use of a paraffin or suitable material. As will be explained, the actual cosmetic pigment or coloring preparation which was utilized to formulate a batch of cosmetic material is at the same time removed from the blending machine and mixed with EVA to provide a module having the exact color as the cosmetic prepared due to the fact that the exact coloring agent has been encapsulated within the EVA module. In this manner, the consumer will experience and see the same exact color as formulated with the original cosmetic product. By the same procedure, an actual sample of the product may be encapsulated within the EVA so the consumer can again see the color in exact detail. Before giving examples of methods and techniques utilized to encapsulate coloring agents or pigments within a hot melt adhesive, indications of various applications of the apparatus and structure will be described to gain a clearer understanding of the utility of the present invention.

Figure 2:
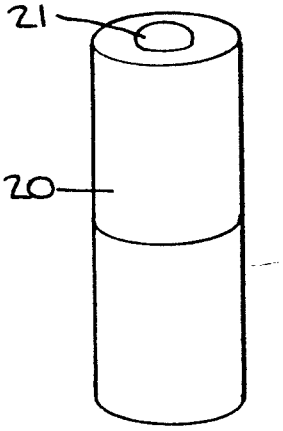
FIG. 2 is a plan view of a lipstick container having a color display according to this invention.

Referring to FIG. 2, there is shown a representation of a typical lipstick holder 20 having impressed thereon a hot melt module 21 containing the exact color of the lipstick included within the container 20.

Figure 3:
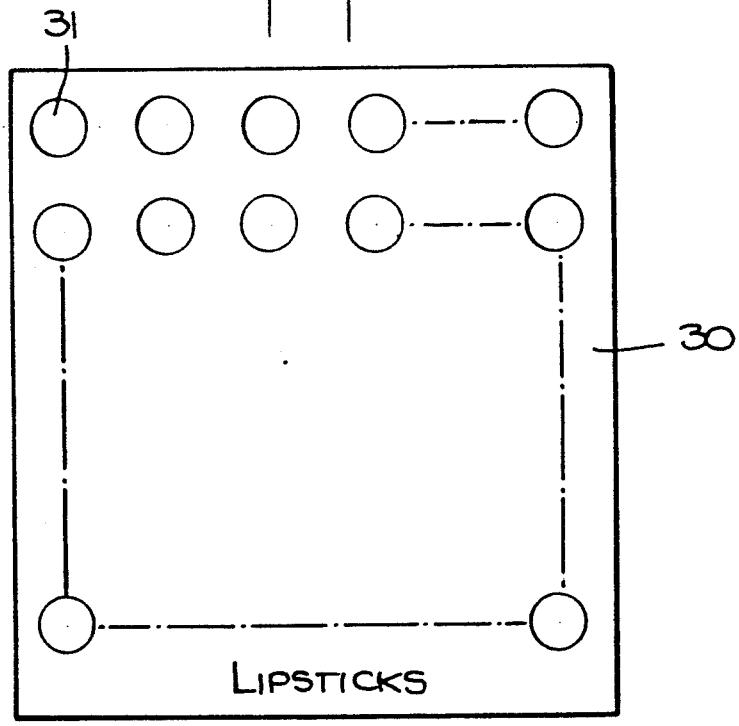
FIG. 3 is a front view of a color display chart according to this invention.

Referring to FIG. 3, there is shown a color chart 30. The color chart 30 has a plurality of hot melt modules 31 each of which was designed and developed utilizing a hot melt adhesive having encapsulated therein the suitable color pigment.

Figure 4:
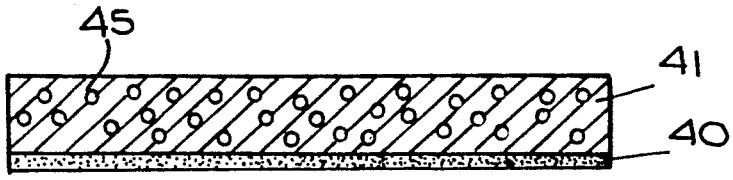
FIG. 4 is a cross sectional view of a color display module according to this invention.

Referring to FIG. 4, there is shown a partial side view of a typical hot melt module according to this invention. As seen in FIG. 4, there is shown a typical substrate material 40 which may be a paper, plastic or other carrier substrate and having secured thereto by means of a suitable adhesive a hot melt color containing module 31. The module 31 can assume any particular configuration and can be embossed, printed upon or otherwise treated to produce many attractive designs such as various geometrical configurations and so on. The module can be embossed or pressed by using a textured die so that one surface appears woven as for example resembling a face powder. The module is secured to a carrier substrate as a sheet of paper, plastic and so on by mean of the adhesive which is intimately associated with the hot melt carrier module.

As seen in FIG. 4, the cross sectional view taken through the module contains pockets of pigment or coloration formulation 45 which are uniformly distributed throughout the hot melt material which as indicated above may be ethylene vinyl acetate copolymer. Associated with the undersurface of the member is a layer of glue or adhesive 40. The glue or adhesive 40 must provide a suitable bonding surface to enable the entire module to be placed upon or secured to any particular carrier substrate such as for example the carton shown in FIG. 1, the lipstick shown in FIG. 2 or the color chart 30 shown in FIG. 3. A preferred type of adhesive is Surlyn or EVA which is a clear hot melt with a melting point of less than 50° F. The temperature does not affect the coloring agents as impregnated in the EV module.

In order to provide a suitable module, the following operations or methods have been implemented. The major ingredient which is used as the hot melt adhesive is ethylene vinyl acetate (EVA). This may be extended with a paraffin substance or otherwise extended. A suitable ethyl vinyl acetate copolymer is available from Quantum which formerly was USI and sold under the designation of UE653-35. This material contains 28 percent vinyl acetate with a melt indexing in grams/10 minutes of 388 correlated from the melt/flow rates obtained from ASTMD 1238, conditions 125/0.325 and 125/2.16. The vinyl acetate material has added to it the pigment coloration or product color to provide the final color display.

Typically, for example, a batch of lipstick of a given color would have in its formulation the exact color composition which would be implemented by means of various pigments. This color formulation would be taken when the lipstick was fabricated and 15 grams or so of the color formulation would be added to 85 grams of the copolymer. Alternatively, an actual sample of the lipstick product could be employed as well. Hence, the actual product can be encapsulated within the EVA. The mixture would then be tumbled by means of a ball mill tumbler for a period of 10 to 12 hours. Then one might add an additional amount of pigment to the mixture With an additional percentage of the EVA and again tumble for a short period of time and the final mixture would then be blended on a plate or by utilizing other heat means. The temperature of the mixture is held below 300° F. The mixture is then stirred or moved by means of a spatula until the mixture becomes of a taffy-like consistency. When this occurs, one immediately scoops the mixture out and applies it as dot to a suitable surface and then presses an image into the mixture by embossing and so on by means of a suitable die. The waste material which is extruded or otherwise removed by the die process can be reworked again by reheating. The modules which are produced according to this can be operated on by many means and the adhesive 40 which is applied to the bottom may also be an EVA adhesive which is coated on the bottom surface of the module after the module has been suitably formed such as by cutting or pressing the module on a die.

The EVA adhesive is extremely sticky and completely compatible with the EVA module. Since the adhesive is structurally similar to the module, there is no chemical reaction between the same enabling the module to be secured to all different types of surfaces. It is indicated that the cohesive energy density is extremely good between the EVA impregnated module and the EVA adhesive.

It is, of course, understood that the adhesive layer 40 can be a polyamide adhesive, many of which are well known in the art. See for example the adhesive produced by General Mills, Inc., Chemical Division, sold under the trademark VERSAMID. This is a polyamide resin which can be utilized in many applications as adhesives. The adhesives are VERSAMID 900, 930, 940, 950 and 100.

The above-noted product can be utilized in many hot melt adhesive applications. It should therefore be apparent to those skilled in the art that there are many techniques which can be employed utilizing the hot melt adhesive as a color display and for example applying the display or module to various carrier substrates by the use of an adhesive backing associated with the module. The applications and uses of the module can further be had by referring to the above-noted copending application.

Hence, those skilled in the prior art can find many uses for such adhesives which are deemed to be encompassed within the spirit and scope of the claims appended hereto.

We claim:

1. A color display module for displaying the color of a cosmetic having a given color formulation, comprising:

a thin planar member of a thermoplastic material having a sample of said cosmetic product uniformly distributed within said thermoplastic material such that the cosmetic product is encapsulated within said thermoplastic material, said sample of said cosmetic product including said given color formulation, whereby said thin planar member replicated the color of said cosmetic product.

2. The module according to claim 1, further including an adhesive layer secured to a major surface of said planar member to enable one to secure said planar member to a carrier substrate.

3. The module according to claim 1, wherein said thin planar member is fabricated from a ethylene vinyl acetate coploymer.

4. The module according to claim 2, wherein said adhesive layer is a thin layer of ethylene vinyl acetate.

5. The module according to claim 2 wherein said adhesive layer is a polyamide adhesive.

6. The module according to claim 2, wherein said carrier substrate is paper.

7. The module according to claim 2, wherein said carrier substrate is cardboard.

8. The module according to claim 1, wherein said thin planar member is embossed on a surface thereof.

9. In combination:

a container including an interior compartment sized and shaped to receive a cosmetic product having a given color formulation and accessing means of permitting access to said compartment by a cosmetic product; and displaying mean for displaying a color, said displaying means being attached to said container and being made from a thermoplastic material having a sample of said cosmetic product uniformly distributed within said thermoplastic material and such that the cosmetic product is encapsulated within said thermoplastic material, said sample of said cosmetic product including said given color formulation, whereby said displaying means replicated the color of said cosmetic product contained within said container without having to open said container.

* * * * *